United States Patent [19]

Spanke et al.

[11] 4,166,415

[45] Sep. 4, 1979

[54] PRESS HAVING OVERLOAD RESPONSIVE SLIDE SHUT HEIGHT ADJUSTING MECHANISM

[75] Inventors: Edwin A. Spanke, Oak Forest; Louis F. Carrieri, La Grange Park, both of Ill.

[73] Assignee: Gulf & Western Manufacturing Company, Southfield, Mich.

[21] Appl. No.: 898,833

[22] Filed: Apr. 21, 1978

[51] Int. Cl.[2] ..... B30B 1/26; B30B 15/28

[52] U.S. Cl. ..... 100/53; 74/583; 100/257

[58] Field of Search ..... 100/53, 257; 83/543; 84/583, 581, 584, 586

[56] References Cited

U.S. PATENT DOCUMENTS

| | | | |
|---|---|---|---|
| 1,808,606 | 6/1931 | Pels | 100/53 X |
| 2,438,951 | 4/1948 | Stephens | 83/543 |
| 2,491,279 | 12/1949 | Rogers | 74/583 |
| 2,936,055 | 5/1960 | Kassnel | 74/583 X |
| 3,160,089 | 12/1964 | Platou | 100/214 |
| 3,190,141 | 6/1965 | Schlatter | 83/543 X |
| 3,793,945 | 2/1974 | Nowak | 100/257 |
| 3,892,143 | 7/1975 | Kleister | 74/583 |
| 4,011,809 | 3/1977 | Waller | 100/53 X |

FOREIGN PATENT DOCUMENTS

| | | | |
|---|---|---|---|
| 577609 | 5/1946 | United Kingdom | 100/53 |

*Primary Examiner*—Billy J. Wilhite

*Attorney, Agent, or Firm*—Meyer, Tilberry & Body

[57] ABSTRACT

The reciprocating slide of a mechanically driven press has a ball and socket type interconnection with the connecting rod of the press drive mechanism. The socket component of the interconnection provides a rotatable adjusting screw threadedly interengaged with an annular piston received in a cylinder component on the slide. A locking nut threadedly engages the adjusting screw and is rotatable relative thereto and to the piston to lock the adjusting screw against displacement relative to the piston. During normal press operation the locking nut is biased against a shoulder on the cylinder by hydraulic fluid under pressure in a variable volume chamber between the piston and cylinder components. In response to an overload on the slide, a pressure responsive relief valve releases hydraulic fluid from the chamber and enables relative movement between the piston and cylinder components and thus between the slide and connecting rod.

19 Claims, 4 Drawing Figures

PRESS HAVING OVERLOAD RESPONSIVE SLIDE SHUT HEIGHT ADJUSTING MECHANISM

The present invention relates to the art of presses and, more particularly, to a press having an improved slide shut height adjusting and overload protection arrangement.

The present invention finds particular utility in connection with mechanical presses of the character including a ball and socket type pivotal connection between the slide and a connecting rod of the press drive mechanism. Accordingly, the invention will be disclosed in detail with regard to such a press. At the same time, however, it will be appreciated that the invention is applicable to presses having connection arrangements other than a ball and socket type connection between the slide and connecting rod.

Mechanical presses of the character having a connecting rod of the press drive mechanism interconnected with the press slide by a ball and socket type interconnection often include a structural arrangement between the slide and connecting rod which enables adjustment of the shut height of the slide relative to the press bed. Such an adjusting mechanism generally includes relatively rotatable threadedly interengaged members one of which is associated with the connecting rod and the other of which is associated with the slide. Rotation of one of the elements relative to the other imparts displacement to the slide relative to the connecting rod and thus to the press bed. In connection with such adjusting arrangements, it is advantageous to enable locking of the adjusting mechanism such that the rotatable elements are interengaged against relative displacement during use of the press. This enables maintaining the desired shut height for the slide during operation of the press and the impact loads and forces which are imposed on the adjusting mechanism as a result of press operation.

In addition to providing such a press with a slide shut height adjusting capability, it is also desirable to provide the press with an overload responsive arrangement which prevents the imposition of undesirable forces and strains on the press components or tooling in response to an overload condition. Hydraulic overload protection systems are desirable for a number of reasons including efficiency of use and operation, dependability and quickness of response, and such hydraulic systems have been employed heretofore in connection with slide shut height adjusting devices. However, such previous slide adjusting and overload protection arrangements are not structurally interrelated so as to be functionally cooperable during operation of the press. Accordingly, such previous arrangements have been structurally complex and bulky, and are expensive.

The present invention advantageously provides a shut height adjusting and locking mechanism between the connecting rod and slide of a press and with which a hydraulic overload protection arrangement is structurally incorporated and functionally cooperable during press operation. This enables compactness of the overall assembly, structural simplicity, efficiency in operation and economical production and use thereof in connection with the press. At the same time, desirable attributes of dependability and quickness of response to an overload condition are etained. More particularly in accordance with the present invention, the slide adjusting and overload responsive mechanism includes piston and cylinder arrangement between the slide and connecting rod of the press drive and interengaged in a manner to enable relative displacement between the slide and connecting rod. The cylinder is associated with one of the slide and connecting rod, and the piston is adjustably mounted on the other of the slide and connecting rod to enable slide shut height adjusting. A locking component is associated with the piston and is cooperable therewith to lock the slide in an adjusted position. Additionally, the locking component limits movement of the piston relative to the cylinder in response to the introduction of hydraulic fluid under pressure between the piston and cylinder. Accordingly, the forces resulting from the hydraulic fluid under pressure are transmitted to the locking component. In response to the imposition of an overload on the slide during press operation, the fluid under pressure between the piston and cylinder is released to enable relative movement therebetween in the direction opposite the one direction, thus to avoid the effects of overload on the component parts of the press. Further, release of hydraulic fluid under pressure from between the piston and cylinder releases the locking component to enable adjustment of the slide shut height.

Preferably, shut height adjustment is achieved by means of a rotatable adjusting screw threadedly interengaged with the piston, and the shut height locking arrangement is provided by a threaded locking nut on the adjusting screw and by hydraulic fluid under pressure between the piston and cylinder, The cylinder includes a shoulder engaged by the locking nut in response to the introduction of hydraulic fluid under pressure between the piston and cylinder. Interengagement between the locking nut and shoulder removes backlash between the threads of the adjusting screw and locking nut, and fluid under pressure between the piston and cylinder removes backlash between the threads of the adjusting screw and piston. Further, interengagement between the locking nut and cylinder shoulder provides full tonage hydraulic fluid pressure retaining capability and the use of a single pressure hydraulic system which, advantageously, minimizes component parts and avoids press strain due to oil compression such as is encountered in a dual pressure hydraulic system.

It is accordingly an outstanding object of the present invention to provide an improved slide shut height adjusting and overload protection arrangement between the slide and connecting rod of the drive mechanism of the press.

Another object is the provision of a slide shut height adjusting and hydraulic overload protection arrangement of the foregoing character in which the component parts are structurally interrelated so as to be functionally cooperable to enable slide adjustment, locking of the slide in a given position during normal press operation, and release of the slide for movement relative to the connecting rod in response to an overload condition.

Still another object is the provision of a slide shut height adjusting and overload protection arrangement of the foregoing character which enables use of a single pressure hydraulic system for overload protection.

A further object is the provision of a slide shut height adjusting and overload protection arrangement of the foregoing character which enables the single pressure hydraulic system to be full press tonage pressure.

Yet a further object is the provision of a slide shut height and overload protection arrangement of the foregoing character which is structurally simple and compact, which is economical to produce, operate and maintain, and which is efficient and dependable in operation.

The foregoing objects, and others, will in part be obvious and in part pointed out more fully hereinafter in conjunction with the written description of a preferred embodiment shown in the accompanying drawings in which.

Figure 1:
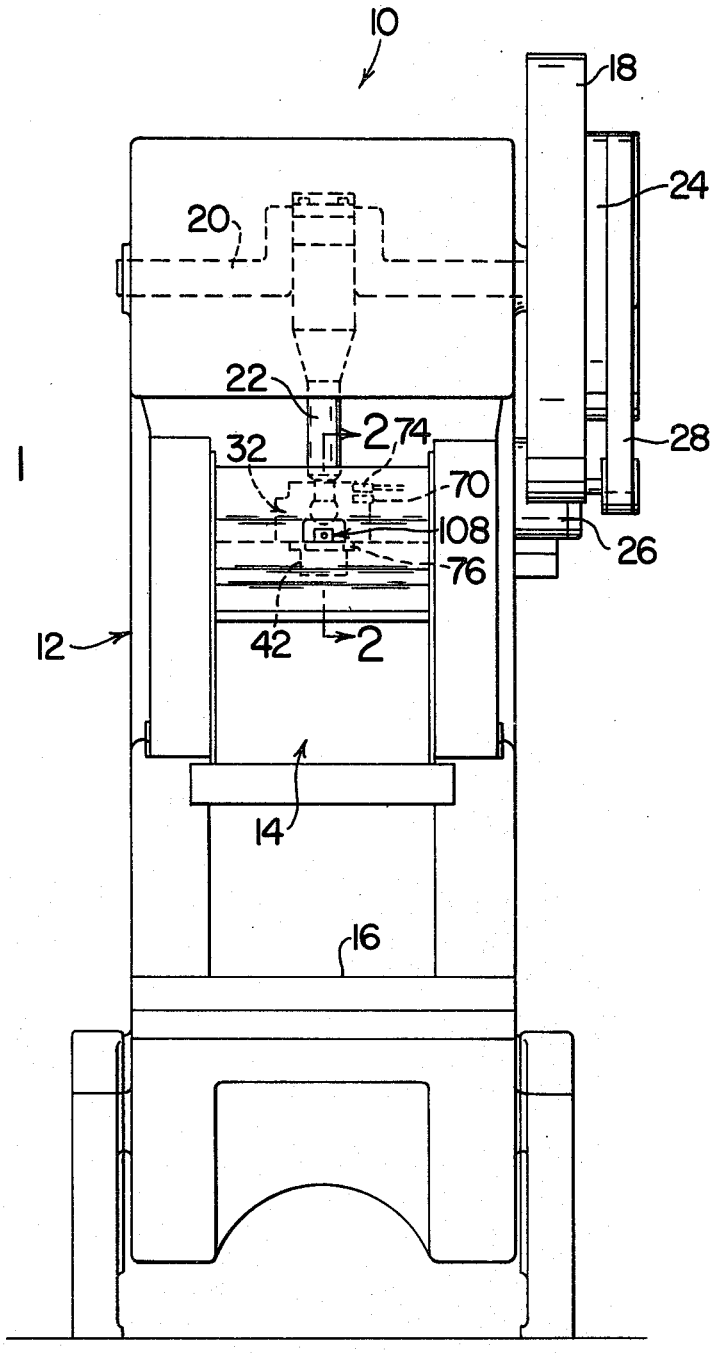
FIG. 1 is a front elevation view of a press incorporating a slide shut height adjusting and overload protection mechanism in accordance with the present invention.

Referring now in greater detail to the drawings wherein the showings are for the purpose of illustrating a preferred embodiment of the invention only and not for the purpose of limiting the invention, FIG. 1 illustrates a press 10 having a frame 12 which supports a slide 14 for reciprocating movement toward and away from press bed 16. The press further includes a flywheel 18 attached to one end of the crankshaft 20 which is interconnected with slide 14 by a connecting rod 22, whereby rotation of crankshaft 20 imparts reciprocating movement to slide 14. In the embodiment shown, flywheel 18 is driven through a brake-clutch unit 24 by means of a drive motor 26 and a drive belt 28 interconnecting the motor and brake-clutch unit. In accordance with the present invention, slide 14 is adjustably interconnected with connecting rod 22 to enable adjusting the shut height of slide 14 or, in other words, the distance between slide 14 and press bed 16 when the slide is in its lowermost or bottom dead center position. Further in accordance with the present invention, the slide shut height adjusting mechanism has an overload protection arrangement structurally incorporated therein and functionally interrelated therewith to enable relative movement between slide 14 and connecting rod 22 in response to the imposition of an overload on the slide during press operation.

The preferred structural arrangement by which the foregoing slide adjusting and overload protection functions are achieved in accordance with the present invention is best seen in FIGS. 2–5 of the drawing. In this respect, slide 14 has an axis 30 and is provided with an annular cylinder member 32 which is coaxial with the slide and mounted thereon such as by bolts 34. While cylinder 32 is shown as a separate component mounted on the slide, it will be appreciated that the cylinder is in effect part of the slide and could be formed integral therewith. Preferably, a cylinder head component 33 is bolted or other wise attached to the upper end of cylinder 32 to protectively enclose component parts of the mechanism which would otherwise be exposed above the cylinder. Slide 14 is provided with a chamber 36 below cylinder 32, and cylinder 32 receives an annular piston 38 which is coaxial with the slide axis. Piston 38 is axially slidable within cylinder 32, and the piston and cylinder are interengaged such as by means of a key 40 which permits axial movement of the piston while restraining rotation thereof relative to cylinder 32.

Piston 38 and slide chamber 36 receive a slide adjusting screw 42 which is coaxial with the slide axis. Adjusting screw 42 has an upper end 44 disposed within the periphery of piston 38 and extending upwardly therefrom and provided with axially extending external gear teeth 46 for the purpose set forth hereinafter. Piston 38 has a lower portion provided internally with butress threads 48 to define a threaded passageway therethrough, and adjusting screw 42 has a lower end 50 provided with external butress threads 52 matingly engaging threads 48 for the purpose set forth hereinafter.

In the embodiment shown, the lower end of connecting rod 22 is provided with a ball 54, and the upper end of adjusting screw 42 is axially recessed to receive socket forming components for ball 54. In this respect, the recessed upper end of adjusting screw 42 receives and supports a lower ball block 56 and an upper ball cap 58, which block and cap members are retained in assembled relationship with ball 54 by means of a retaining ring 60 attached to the upper end of adjusting screw 42 by means of a plurality of bolts 62. It will be appreciated of course that the ball block and ball cap members are contoured for mating engagement with ball 54 to swivelly interconnect connecting rod 22 and slide 14. Thus, adjusting screw 42 is adapted to rotate relative to slide 14 through the threaded interconnection between screw 42 and piston 38 and is adapted to rotate relative to connecting rod 22 through the ball and socket connection.

It will be appreciated of course that slide 14 and connecting rod 22 are restrained against rotation about slide axis 30 by their respective interengagements with the press frame and crankshaft. It will be further appreciated that adjusting screw 42 is axially fixed with respect to connecting rod 22 by the ball and socket interconnection therebetween. Accordingly, rotation of adjusting screw 42 relative to the slide and connecting rod about slide axis 30 rotates threads 52 of the adjusting screw relative to threads 48 on piston member 38, thus causing axial displacement of slide 14 relative to connecting rod 22. Rotation of adjusting screw 42 can be achieved in any desired manner. In the embodiment shown, rotation is achieved by means including a slide adjusting gear 64 rotatably mounted between cylinder 32 and cylinder head 33 such as by means of a pin 66. Gear 64 includes an upper worm wheel portion 68 and a lower pinion portion 70 having axially extending teeth 72 in meshing engagement with external teeth 46 on adjusting screw 42. Gear 64 is adapted to be rotated about its axis and relative to cylinder 32 by a worm gear 74 supported by the slide for rotation about an axis perpendicular to pin 66. Worm gear 74 can be rotated in any suitable manner. For example, the worm gear can be rotated by a motor carried on the slide, or can be manually rotated such as by a crank. Slide adjusting gear 64 is axially fixed relative to cylinder 32 and thus is axially displaced with slide 14, and external gear teeth 46 on the upper end of adjusting screw 42 slide axially relative to gear teeth 72 on pinion 70 during relative axial displacement between the slide and connecting rod. The lineal extent of axial adjustment available between the slide and connecting rod is of course determined by the axial length of gear teeth 46 and the axial length of threads 52 on adjusting screw 42.

When the slide has been adjusted relative to the connecting rod by rotation of adjusting screw 42, it is desirable to lock the adjusting components against relative rotation displacement in order to maintain the desired shut height for the slide. In the embodiment shown, such locking is achieved in part by a locking nut 76 coaxial with and surrounding adjusting screw 42 and located below piston 38. Locking nut 76 has internal butress threads 78 matingly interengaging exterior threads 52 on adjusting screw 42. Locking nut 76 is restrained against rotation relative to adjusting screw 42 and is maintained in a desired axial and angular relationship relative to piston 38 which will provide a running clearance between the threads 48 and 78 of the piston and locking ring and threads 52 of the adjusting screw. More particularly in this respect, piston 38 and locking ring 76 are interengaged by one or more bolts 80 extending through an opening 82 in piston 38 and a corresponding opening 84 in locking ring 76. Bolts 80 angularly position piston 38 and locking ring 76 relative to one another to provide the necessary thread clearance for rotation of adjusting screw 42 relative thereto during a slide shut adjusting operation. For the purpose set forth hereinafter, the lower ends of bolts 80 have nuts 86 thereon or are otherwise headed to provide an axial clearance space 88 between locking ring 76 and nuts 86.

Chamber 36 in slide 14 has a radially enlarged upper end beneath cylinder 32 and in which locking nut 76 is disposed, and the lower end of cylinder 32 includes a radially inwardly extending circumferential wall 92 which provides an abutment overlying the radially outer end of locking nut 76. The upper side of locking nut 76 is adapted to interengage with bottom surface 96 of cylinder wall 92 to limit upward displacement of piston 38 relative to cylinder 32. As will become more apparent hereinafter, engagement of locking ring 76 with surface 96 resists adjusting screw rotation during operation of the press and thus assists in maintaining the slide in a given shut height position.

Figure 2:
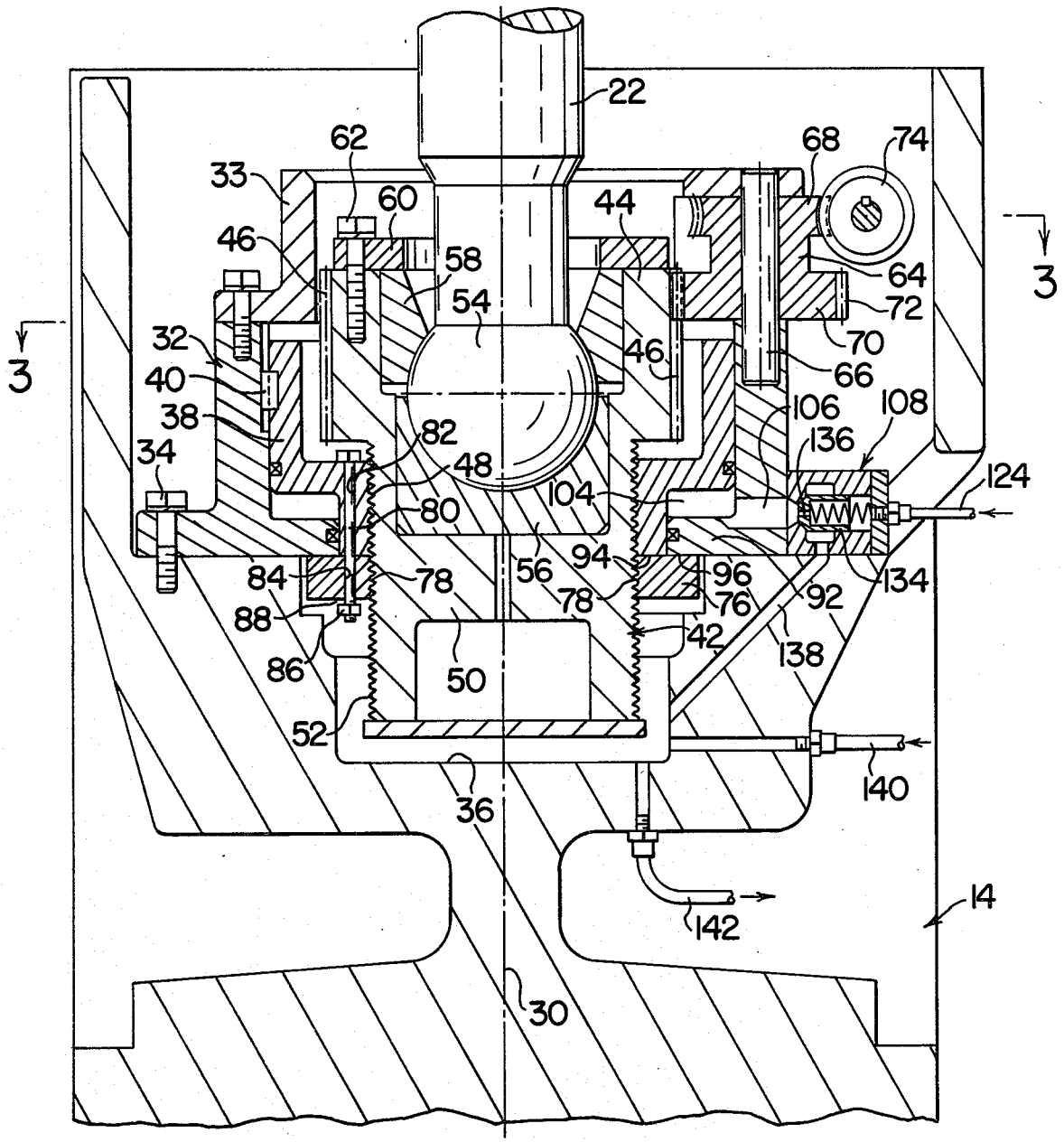
FIG. 2 is a sectional elevation view of the slide taken along line 2—2 in FIG. 1 and showing the slide adjusting and overload protection mechanism in detail.
Figure 3:
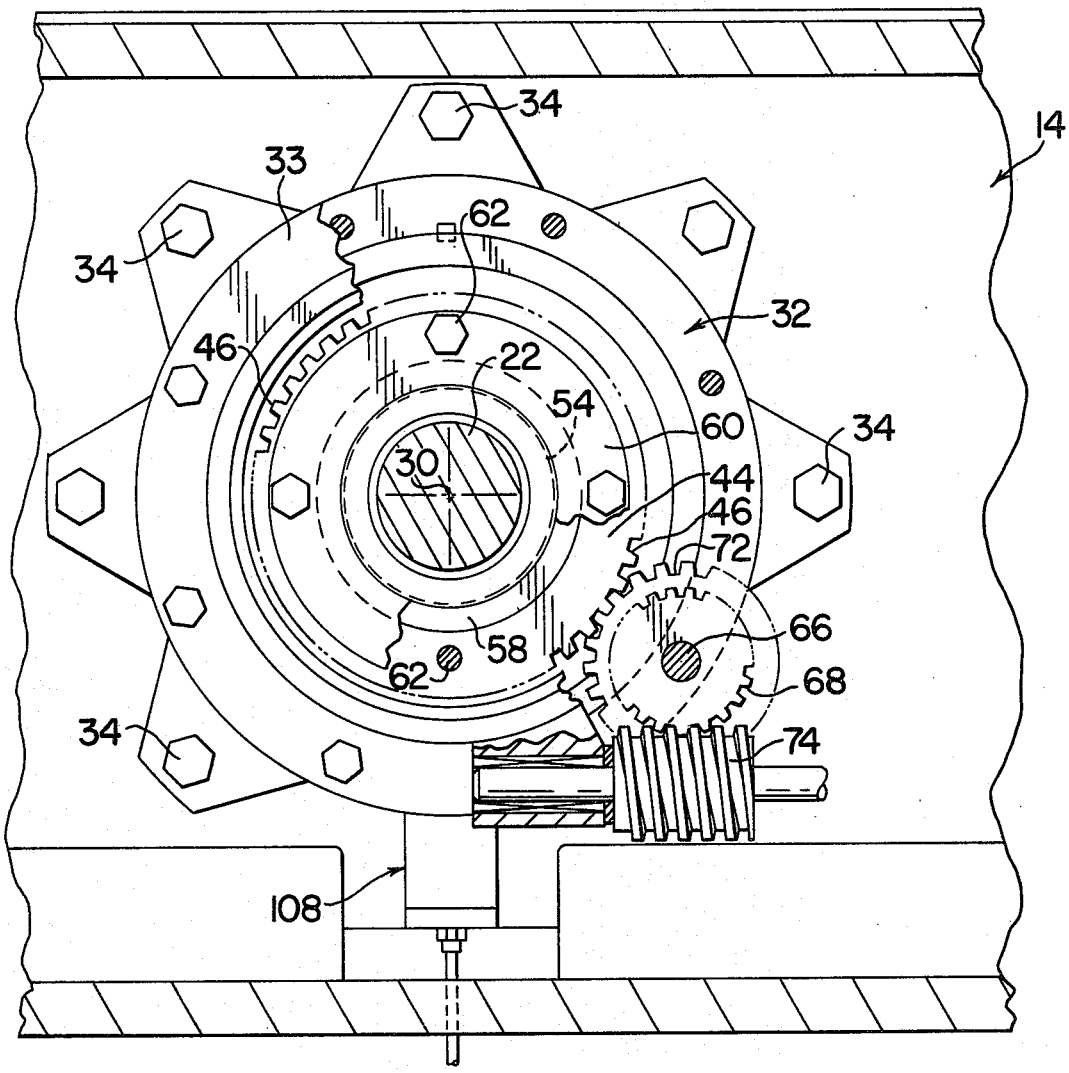
FIG. 3 is a cross-sectional view of the mechanism taken along line 3—3 in FIG. 2; and, FIG. 4 is a schematic illustration of the hydraulic fluid system for the slide adjusting and overload protection mechanism.

Slide shut height locking is further achieved in part by the relationship between piston 38 and cylinder 32. When piston 38 is displaced upwardly relative to slide 14 and cylinder 32, as limited by engagement of locking nut 76 with bottom surface 96 of cylinder wall 92, the piston and cylinder components are positioned relative to one another as seen in FIG. 2. When so positioned, the piston and cylinder components cooperatively define an annular variable volume chamber 104 therebetween. Chamber 104 is adapted to receive hydraulic fluid under pressure through a passageway 106 in cylinder 32 and an overload release valve 108 of a hydraulic supply system described hereinafter. During normal press operation, hydraulic fluid under pressure in chamber 104 biases the component parts to the position shown in FIG. 2, thus tightly interengaging locking nut 76 with surface 96 of the cylinder. This provides for the forces resulting from the fluid pressure in chamber 104 to be transmitted to the locking nut and biases the locking nut against cylinder surface 96 to remove backlash between adjusting screw threads 52 and locking ring threads 78 thus to restrain rotational displacement of adjustment screw 42 relative to piston 38 during normal press operation, as mentioned above. Moreover, the hydraulic pressure in chamber 104 biases piston 38 upwardly relative to locking ring 76 to remove backlash between adjusting screw threads 52 and piston threads 48 to restrain rotational displacement of screw 42 relative to piston 38 during press operation. Clearance space 88 mentioned allows axial displacement between piston 38 and locking nut 76 necessary for such backlash removal.

Upon the imposition of an overload on the slide, relief valve 108 operates as set forth hereinafter to release hydraulic fluid under pressure from chamber 104, whereby cylinder 32 and thus slide 14 can move axially relative to piston 38 and thus connecting rod 22. For example, with reference to FIGS. 1 and 2, should slide 14 encounter an obstruction during movement thereof toward the press bed creating an overload condition, the release of hydraluic fluid from chamber 104 enables piston 38 and thus connecting rod 22 to descend relative to cylinder 32 and slide 14.

Figure 4:
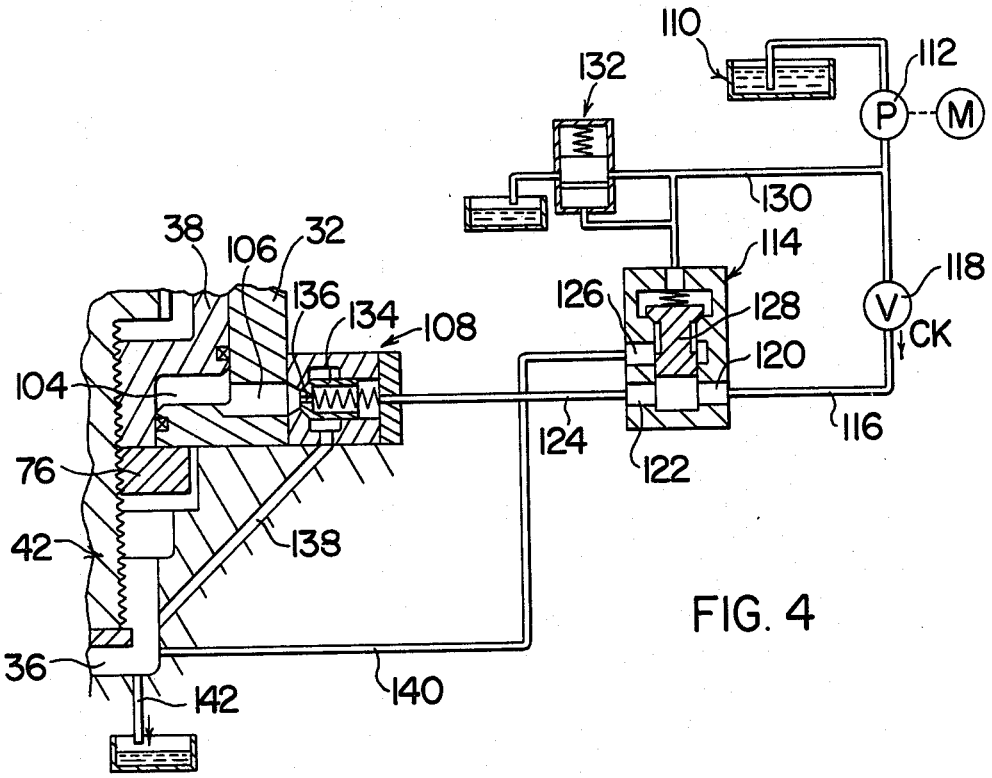

As mentioned above, the component parts of the mechanism are normally in the positions thereof shown in FIG. 2 and are maintained in these positions by hydraulic fluid under pressure in chamber 104. A hydraulic circuit for this purpose and for releasing fluid under pressure from chamber 104 in response to an overload condition is schematically shown in FIG. 4 of the drawing. In this respect, the hydraulic circuit includes a source of hydraulic fluid 110 and a motor driven pump 112 for delivering fluid to the press at a given pressure. Pump 112 delivers fluid under pressure to a pressure relief control valve 114 by means of a flow line 116 therebetween and which flow line includes a check valve 118 to prevent back flow to the pump. Fluid flows from line 116 through passageways 120 and 122 of valve 114 to flow line 124 leading to overload relief valve 108. Valve 114 includes a discharge passageway 126 normally closed by a valve spool 128. Pump 112 is also connected to valve 114 by a flow line 130, whereby it will be appreciated that the opposite ends of valve spool 28 are exposed to system pressure. A pump pressure relief valve 132 is in flow communication with line 130 to relieve pump pressure which exceeds the predetermined system pressure. Overload relief valve 108 includes a slidable valve element 134 provided with a bleed orifice 136 communicating with passageway 106 in cylinder member 32. Orifice 136 permits system fluid under pressure to flow to chamber 104. Valve 108 is further provided with a discharge passageway 138 leading to slide chamber 36, and discharge passageway 126 of valve 114 is also connected to slide chamber 36 by means of a flow line 140. Slide chamber 36 is provided with a discharge passageway 142 suitably connected to return hydraulic fluid in chamber 36 to fluid source 110 or to a suitable collection receptacle.

During normal press operation, fluid at the desired system pressure is delivered to chamber 104 through valves 114 and 108 to maintain cylinder 32 and piston 38 in the relative positions thereof shown in FIG. 2. In response to an overload on the press, causing relative displacement between the piston and cylinder components as set forth hereinabove, the increase in fluid pressure in chamber 104 displaces valve element 134 in valve 108 to the right in FIG. 4 to connect chamber 104 with discharge line 138, whereby the hydraulic fluid in chamber 104 is discharged to slide chamber 36. At the same time, such displacement of valve element 134 increases the pressure in line 124 above system pressure, whereby valve element 128 of valve 114 is displaced upwardly from the position shown in FIG. 4 to open discharge passageway 126 and to place the latter in flow communication with lines 124 and 130. Thus, fluid under pressure in these lines flows through line 140 to slide chamber 36 and thence through discharge passageway 142 leading from the slide chamber. Accordingly, system pressure is immediately reduced to enable immediate response to the overload condition. It will be appreciated of course that suitable controls can be incorporated in the press or in the hydraulic circuit to shut down the press simultaneous with such response to the overload condition.

To achieve adjustment of the shut height of the slide the hydraulic system is de-energized to relieve the pressure in chamber 104 and thus the bias of locking nut 76 against cylinder wall 92. Accordingly, adjusting screw 42 is freed for rotation relative to locking nut 76 and piston 38 and which rotation is achieved as described above through rotation of pinion 70. Rotation of pinion 70 adjusts the axial position of adjusting screw 42 relative to piston 38 and thus slide 14. Following such adjustment, the hydraulic system is reactivated to deliver hydraulic fluid under pressure to chamber 104 to bias the locking ring against surface 96 of cylinder wall 92 and to bias piston 38 relative to locking ring 76 as described above to lock the slide in the adjusted shut height position.

While considerable emphasis has been placed herein on the preferred embodiment illustrated and described, it will be appreciated that other embodiments of the invention and changes in the preferred embodiment can readily be made without departing from the principles of the present invention. In this respect, for example, the cylinder component can be on the connecting rod of the press drive rather than on the slide, and the adjusting screw can be mounted on the slide rather than on the end of the connecting rod. In one possible arrangement of this character the cylinder could be swivelly interconnected with the connecting rod by a ball and socket type connection, and the adjusting screw would be fixed to the slide against rotation relative thereto. The internally threaded piston would be received on the adjusting screw and would be keyed to the cylinder and axially slidably disposed in the cylinder. Shut height adjustment would be achieved by rotating the piston and cylinder relative to the adjusting screw. A locking nut would of course engage an abutment on the cylinder in the manner and for the purpose described herein in connection with preferred embodiments. In another possible arrangement, the cylinder would be fixed with respect to the connecting rod and the adjusting screw would be interengaged with the slide by a ball and socket type interconnection. The piston would be threadedly associated with the adjusting screw and axially slidably received in the cylinder and keyed to the cylinder against rotation relative thereto. Accordingly, adjustment of the slide shut height would be achieved by rotating the adjusting screw relative to the piston and cylinder. In a possible modification of the preferred embodiment herein illustrated and described, the adjusting screw could be mounted on the connecting rod against rotation relative thereto and the keyed interengagement between the piston and cylinder component eliminated to enable rotation of the piston relative to the cylinder and adjusting screw to achieve shut height adjustments.

The foregoing and other embodiments of the invention and further modifications of the preferred embodiment herein illustrated and described will be apparent or suggested to those skilled in the art from the description herein of the preferred embodiment. Accordingly, it is to be distinctly understood that the foregoing descriptive matter is to be interpreted merely as illustrative of the present invention and not as a limitation.

Having thus described the invention, it is claimed:

1. A press comprising frame means including a bed, a slide supported by said frame means for reciprocating movement toward and away from said bed, drive means for reciprocating said slide and including connecting rod means, and overload responsive slide shut height adjusting means interconnecting said slide and connecting rod means, said adjusting means including cylinder means on one of said slide and connecting rod means, piston means, means axially adjustably mounting said piston means on the other of said slide and connecting rod means, said piston means being axially reciprocably received in said cylinder means, means to limit movement of said piston means in one direction relative to said cylinder means, and hydraulic circuit means including means to deliver hydraulic fluid under pressure between said piston means and cylinder means to move said piston means in said one direction and means to release fluid under pressure from between said piston means and cylinder means in response to an overload on said slide for said piston means to move relative to said cylinder means in the direction opposite said one direction.

2. The press according to claim 1, wherein said piston means is an internally threaded annular piston and said means adjustably mounting said piston means includes an externally threaded member on said other of said slide and connecting rod means threadedly receiving said piston.

3. The press according to claim 2, wherein said means to limit movement of said piston means includes means mounted on said externally threaded member and abutment means on said cylinder means engaged by said means mounted on said threaded member.

4. The press according to claim 3, wherein said means mounted on said threaded member is an internally threaded locking nut threadedly received on said externally threaded member.

5. The press according to claim 1, wherein said slide is said one of said slide and connecting rod means.

6. The press according to claim 5, wherein said piston means is an internally threaded annular piston and said means adjustably mounting said piston means includes an externally threaded member on said connecting rod means threadedly receiving said piston.

7. The press according to claim 6, and means to relatively rotate said piston and said externally threaded member to adjust the position of said piston axially of said externally threaded member.

8. The press according to claim 7, wherein said means to limit movement of said piston means includes means mounted on said externally threaded member and abutment means on said cylinder means engaged by said means mounted on said threaded member.

9. The press according to claim 8, wherein said connecting rod means includes an end, and ball and socket means swivelly interconnecting said end and said externally threaded member.

10. The press according to claim 9, wherein said means to relatively rotate said piston and said externally threaded member includes means interengaging said piston with said cylinder means against rotation relative thereto, and means to rotate said externally threaded member relative said piston.

11. A press comprising frame means including a bed, a slide supported by said frame means for reciprocating movement toward and away from said bed, drive means for reciprocating said slide and including connecting rod means, and overload responsive slide shut height adjusting means interconnecting said slide and connecting rod means, said adjusting means including cylinder means, externally threaded means coaxial with said cylinder means, internally threaded annular piston means threadedly received on said externally threaded means and axially slidably received in said cylinder means, said piston means and cylinder means cooperatively defining a variable volume fluid receiving chamber therebetween which increases in response to axial movement of said piston means relative to said cylinder means in one direction, locking nut means threadedly received on said externally threaded means, said cylinder means including abutment means engaged by said locking nut means to limit movement of said piston means relative to said cylinder means in said one direction, one of said cylinder means and externally threaded means being on said slide and the other on said connecting rod means, means to relatively rotate said piston means and said externally threaded means to adjust said slide shut height, and hydraulic circuit means including means to deliver hydraulic fluid under pressure to said fluid receiving chamber to bias said locking nut means against said abutment means and pressure responsive means to release fluid from said chamber in response to an overload on said slide for said piston means to move relative to said cylinder means in the direction opposite said one direction.

12. The press according to claim 11, wherein said locking nut means is adjacent said piston means, and means interconnecting said piston means and locking nut means against rotation relative to one another and for rotation of said externally threaded means relative thereto.

13. The press according to claim 12, wherein said means interconnecting said piston means and said locking nut means includes bolt means extending axially therethrough and providing for axial displacement therebetween.

14. The press according to claim 11, wherein said cylinder means is on said slide and said externally threaded means includes an adjusting screw swivelly interconnected with said connecting rod means and rotatable relative to said cylinder means.

15. The press according to claim 14, wherein said means to relatively rotate said piston means and said external threaded means includes means interengaging said piston means with said cylinder means against rotation relative thereto, and means to rotate said adjusting screw relative to said piston means.

16. The press according to claim 15, wherein said adjusting screw includes gear means and said means to rotate said adjusting screw includes pinion means rotatably supported on said slide in meshing engagement with said gear means.

17. The press according to claim 16, wherein said locking nut means is adjacent said piston means, and means interconnecting said piston means and locking nut means against rotation relative to one another and for rotation of said adjusting screw means relative thereto.

18. The press according to claim 17, wherein said means interconnecting said piston means and said locking nut means includes bolt means extending axially therethrough and providing for axial displacement therebetween.

19. The press according to claim 18, wherein said connecting rod means includes a ball and said adjusting screw includes means providing a socket for said ball, said ball and socket defining said swivel interconnection between said adjusting screw and said connecting rod means.

* * * * *

Disclaimer 4,166,415.—*Edwin A. Spanke,* Oak Forest and *Louis F. Carrieri,* La Grange Park, Ill. PRESS HAVING OVERLOAD RESPONSIVE SLIDE SHUT HEIGHT ADJUSTING MECHANISM. Patent dated Sept. 4, 1979. Disclaimer filed July 6, 1981, by the assignee, *Gulf & Western Manufacturing Co.*

Hereby enters this disclaimer to claims 1 and 5 of said patent.

[*Official Gazette October 13, 1981.*]